US005745140A

United States Patent [19]

Stoffel et al.

[11] Patent Number: 5,745,140

[45] Date of Patent: Apr. 28, 1998

[54] COLOR INK-JET PRINTER WITH PIGMENT BLACK AND DYE-BASED COLOR INKS

[75] Inventors: John L. Stoffel, San Diego; Keshava A. Prasad, San Marcos; Ronald A. Askeland, San Diego; Michele E. Shepard, Escondido; Frank Drogo, San Marcos; Leonard Slevin, San Diego, all of Calif.; Mark S. Hickman, Vancouver, Wash.; Clayton L. Holstun, Escondido, Calif.

[73] Assignee: Hewlett-Packard Company, Palo Alto, Calif.

[21] Appl. No.: 626,432

[22] Filed: Apr. 2, 1996

Related U.S. Application Data

[63] Continuation of Ser. No. 234,209, Apr. 28, 1994, abandoned.

[51] Int. Cl.[6] ..... B41J 2/01

[52] U.S. Cl. ..... 347/100; 347/102

[58] Field of Search ..... 347/100, 102, 347/24, 43; 106/31.13

[56] References Cited

U.S. PATENT DOCUMENTS

| | | | |
|---|---|---|---|
| 4,872,026 | 10/1989 | Rasmussen et al. | 346/140 R |
| 5,091,005 | 2/1992 | Mueller et al. | 106/22 |
| 5,098,476 | 3/1992 | Baker | 106/22 |
| 5,100,470 | 3/1992 | Hindagolla et al. | 106/22 |
| 5,106,416 | 4/1992 | Moffatt et al. | 106/20 |
| 5,108,503 | 4/1992 | Hindagolla et al. | 106/22 |
| 5,112,399 | 5/1992 | Slevin et al. | 106/22 |
| 5,116,409 | 5/1992 | Moffatt | 106/22 |
| 5,118,350 | 6/1992 | Prasad | 106/22 |
| 5,133,803 | 7/1992 | Moffatt | 106/25 |
| 5,196,056 | 3/1993 | Prasad | 106/15.05 |
| 5,198,023 | 3/1993 | Stoffel | 106/22 R |
| 5,221,334 | 6/1993 | Ma et al. | 347/100 |
| 5,320,668 | 6/1994 | Shields et al. | 347/100 |
| 5,342,439 | 8/1994 | Lauw | 347/100 |

FOREIGN PATENT DOCUMENTS

| | | | |
|---|---|---|---|
| 0501800A2 | 9/1992 | European Pat. Off. | 347/24 |
| 03130158 | 6/1991 | Japan | 347/102 |

OTHER PUBLICATIONS

*Hewlett–Packard Journal* (vol. 45, No. 1, Feb. 1994).

*Primary Examiner*—Valerie Lund

[57] ABSTRACT

A color ink-jet printer is provided, with one pen for dispensing black ink onto a print medium and at least one pen for dispensing color ink onto a print medium. The pen for dispensing black ink contains a pigment-based ink and the pen(s) for dispensing color ink contain a water-miscible dye-based ink. Such a color ink-jet printer provides both superior text quality (black ink) and relative ease of service (color inks), since the black ink is used more than the color inks and thus tends to require less spitting due to its frequency of use. On the other hand, since the color inks are used less, the utilization of water-miscible inks, which require less spitting than pigmented inks to keep the nozzle clear, also require less spitting even with relatively lower frequency of use.

15 Claims, 2 Drawing Sheets

COLOR INK-JET PRINTER WITH PIGMENT BLACK AND DYE-BASED COLOR INKS

This is a continuation of application Ser. No. 08/234,209 filed on Apr. 28, 1994, now abandoned.

TECHNICAL FIELD

The present invention relates generally to ink-jet printers, and, more particularly, to color thermal ink-jet printers.

BACKGROUND ART

Ink-jet printers capable of forming color images using an ink set derived from cyan, yellow, magenta, and black inks are now commercially available. Specific types of ink-jet printers, such as thermal and piezoelectric, are also well-known.

The formation of color images onto the print medium, e.g., paper, requires inks having competing requirements. For example, the ink must be relatively quick drying, so as to avoid smearing of images. Yet, the ink must not be so quick drying that it clogs the printhead nozzles out of which it is jetted. Further, when printing color images, bleed (the invasion of one color by another) must be avoided. Various patents have been issued dealing with dye-based color components; examples of such patents, which are assigned to the same assignee as the present application, include U.S. Pat. Nos. 5,091,005, 5,098,476, 5,100,470, 5,106,416, 5,108,503, 5,112,399, 5,116,409, 5,118,350, 5,133,803, 5,196,056, 5,198,023. Typically, these inks comprise a liquid vehicle (one or more water-miscible organic solvents and water) and one or more water-soluble dyes, or colorants. Additives may be present to improve a given property, such as water-fastness, color bleed, and the like.

Pigmented inks have been found to provide superior text quality, when compared to water-miscible inks, which employ water-soluble dyes. Pigmented inks typically comprise one or more pigmented color components dispersed in a vehicle with a dispersant. In addition to superior text quality, pigmented inks also have the advantage of providing superior lightfastness. On the other hand, however, pigmented inks have the disadvantage of being harder to service. Maintaining a clean orifice plate in the printhead by wiping is more difficult with a pigmented ink than with a water-miscible ink. In general, more spitting and wiping of a pigmented ink is required to keep the nozzles in good condition than with a water-miscible ink.

Thus, an ink set that combines the advantages of both types of inks (pigmented and water-miscible), while alleviating the disadvantages of each, is required.

DISCLOSURE OF INVENTION

In accordance with the present invention, a color ink-jet printer is provided, with one print cartridge for dispensing black ink onto a print medium and at least one print cartridge for dispensing color ink onto a print medium. The cartridge for dispensing black ink contains a pigment-based ink and the cartridge(s) for dispensing color ink each contain at least one water-miscible dye-based ink.

Such a color ink-jet printer provides both superior text quality (black ink) and relative ease of service (color inks), due to using one pigment ink and at least one dye-based ink.

BEST MODES FOR CARRYING OUT THE INVENTION

Figure 1:
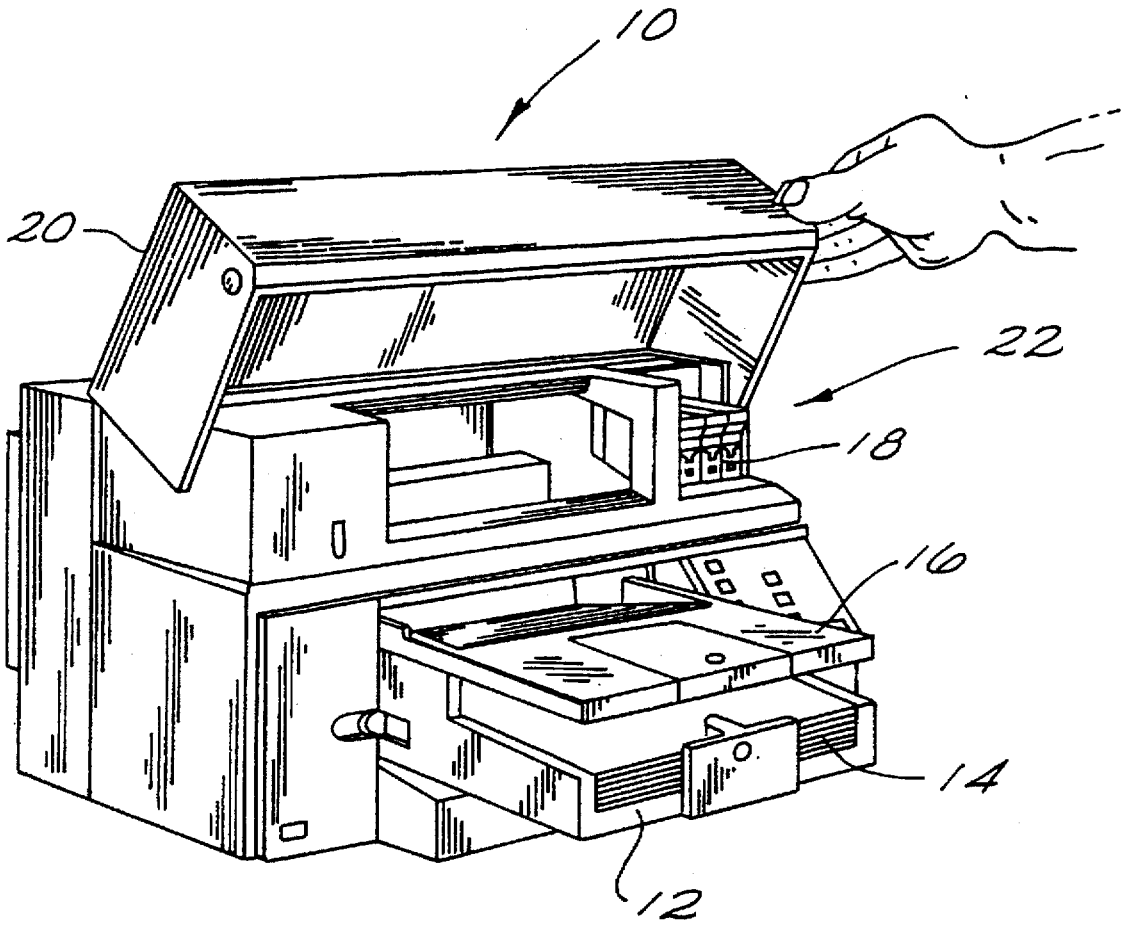
FIG. 1 is a perspective view of an exemplary ink-jet printer employed in the practice of the present invention.

Referring now to the figures, a printer 10 is shown in FIG. 1, comprising a paper feed tray 12 for storing a supply of paper or other print medium 14 to be printed, a paper collection tray 16 for collecting the printed paper, and a plurality of print cartridges 18. In the printer depicted in FIG. 1, four such cartridges are provided: cyan, yellow, magenta, and black, commonly referred to as CYMK, although only three are visible from the viewing angle chosen. Together, these four colors provide a wide palette of colors, tints, and hues. However, it will be readily appreciated by those skilled in this art that black plus at least one of cyan, yellow, and magenta may be employed in certain situations.

The printer 10 is depicted with its cover 20 raised to expose the service station 22 and the four cartridges 18 stored therein. Other features of the printer 10, such as the paper feed mechanism, printer electronics, etc., are not depicted, as they are well-known of ink-jet printing; see, e.g., U.S. Pat. No. 4,872,026, issued Oct. 3, 1989, and assigned to the same assignee as the present application.

The print cartridges 18 reside in the service station 22 when not in use or for servicing, which may include priming the pen, wiping the nozzle plate, and/or spitting all nozzle simultaneously into a spittoon to clear them.

The print cartridges may be based on thermal jetting action, employing a plurality of ink firing chambers, each containing a resistor element that, upon energizing, causes a bubble of ink to form, which is expelled through a nozzle toward the print medium. Alternatively, the print cartridge may be based on piezoelectric jetting action, employing a plurality of ink firing chambers, each containing a piezoelectric element that, upon energizing, expels a quantity of ink through a nozzle toward the print medium. Both thermal and piezoelectric print cartridges are well-known in the art of ink-jet printing. Preferably, a thermal ink-jet printer is employed in the practice of the present invention.

The configuration of the cartridges is immaterial in the practice of the present invention, and may comprise two, three, or four separate cartridges, or pens (as depicted in FIG. 1) or may comprise one pen with two, three, or four print cartridges, each containing a different ink. As used herein, the term "cartridge" is intended to cover both the situation involving separate pens (in which case, pen and cartridge are synonymous) and a monolithic pen containing multiple cartridges. In the latter case, the cartridges may be individually replaceable or tube-fed with ink from an off-axis ink supply.

In the use of an ink-jet printer, the platen may be at ambient temperature or the platen may be heated. A heated platen in conjunction with a thermal ink-jet printer has been disclosed and claimed in application Ser. No. 07/876,942, filed May 1, 1992, and in application Ser. No. 08/056,287, filed Apr. 30, 1993, which in turn is a continuation-in-part application of Ser. No. 07/876,924, filed May 1, 1992, all assigned to the same assignee as the present application. Heated platens are used to dry the ink faster on the print medium, which may be paper, transparency, or other suitable material.

Figure 2:
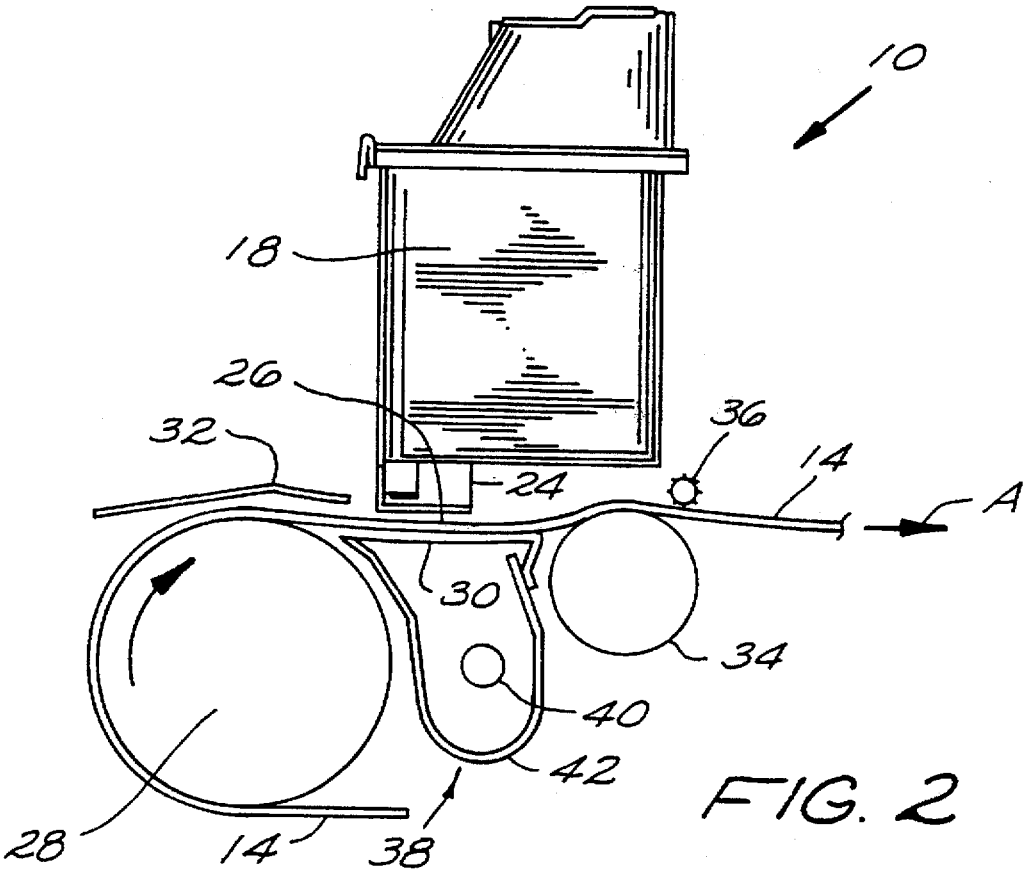
FIG. 2 is a schematic drawing of a portion of a thermal ink-jet printer, employing heating means, depicting the relation of the pen with its printhead to the print medium and heating means.

FIG. 2 depicts a portion of the ink-jet printer 10 shown in FIG. 1, which is provided with a heated platen means. Specifically, the print medium is moved past the pen, or print cartridge, 18 having affixed thereto a printhead 24 in operative association with the print medium 14. The printhead 24 establishes a print zone 26. As is customary, the print medium 14 is moved along a paper path in the printer 10, in the direction denoted by arrow A, and the pen 18 is moved orthogonal thereto. The print medium 14 is moved by a drive roller 28 onto a screen 30. A drive plate 32, positioned after the drive roller 28 and prior to the pen 18 aids in holding the print medium 14 flat on the screen 30. The screen 30, which acts like a platen, is perforated so as to permit the drying of the print medium, as described more fully below. The print medium 14 exits the print zone 26 by means of an exit roller 34 and a plurality of starwheels 36 to be collected in the paper collection means, such as tray 16.

A recent modification in thermal ink-jet printers involves the use of a heating means, generally depicted at 38, which is positioned close to the print zone 18. In FIG. 2, the heating means 38 is depicted as comprising a print heater 40 and a reflector 42, which serves to concentrate the heat on the bottom of the print medium 14, through the screen 30. However, it will be readily apparent to those skilled in the art that the heating means 38 may comprise any of the usual heating sources, such as heating elements, blowers, and the like, and the practice of the present invention is not limited as to the heating source. Nor is the present invention limited to the placement of the heating source 38, which may be ahead of the print zone 26, behind the print zone, or in the print zone or which may be located beneath the print medium 14, as shown, or above it.

Figure 3:
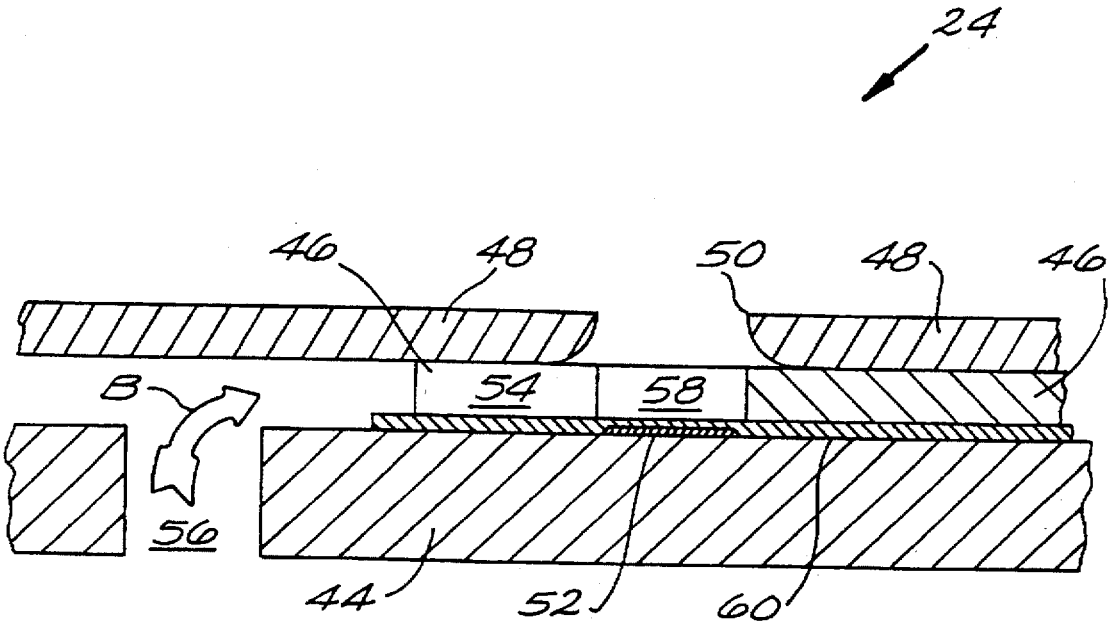
FIG. 3 is a cross-sectional view of a portion of a printhead in an ink pen, depicting one resistor element and its associated nozzle.

FIG. 3 depicts in cross-section et portion of the printhead 24, comprising a substrate 44, a barrier layer 46, and an orifice, or nozzle, plate 48 with an orifice, or nozzle, 50 therein. The nozzle 50 is positioned above a thermal element 52, commonly a resistor element, or heater-resistor. In practice, the orifice plate 48 has a plurality of nozzles 50 in it, each one operatively associated with a resistor 52, as is well-known. The present invention is not limited to the particular orifice plate 48 employed, which may be separate or integral with the barrier layer 46. Indeed, any orifice plate overlying the thermal element 52 may be employed in the practice of the present invention.

In operation, ink fills an ink feed channel 54, as shown by arrow B; each resistor is fed by such a channel, which is defined by the substrate 44, the barrier layer 46, and the orifice plate 48. Each resistor 52 is connected by an electrically conductive trace (not shown) to a current source (not shown), which, under the control of a microprocessor (not shown), sends current pulses to selected resistors 52, causing a droplet of ink to be expelled through the nozzle 50 and onto the print medium 14 in a desired pattern of alphanumeric characters, graphics, area-fill, and other print patterns. The details of such thermal ink-jet printers are described, for example, in the Hewlett-Packard Journal, Vol. 45, No. 1 (February 1994).

As further shown in FIG. 3, the ink flows up from through ink refill slot 56, into the ink feed channel 54, and thence into firing chamber 58. A passivation layer 60 lies over the substrate 44 and the resistor 52. This passivation layer 60 typically comprises a silicon nitride-silicon carbide material, as is well-known. Additionally, there are several other layers in the thin film construction of a thermal ink-jet printhead; these are omitted from the drawing for clarity.

In accordance with the present invention, the black ink is pigment-based, while each of the color inks contains at least one water-miscible dye. The particular pigment and dispersant employed for the black ink and the water-miscible dyes employed for the color inks in the practice of the present invention are those commonly employed in ink-jet printing.

The black ink, since it is used primarily for text and since text is printed more frequently than graphics, does not cause clogging of the nozzles to a great extent, compared to the color inks, due to its greater frequency of use. Further, the pigmented black ink gives better edge acuity than dye-based inks. Edge acuity has been identified as being more important in the printing of text as compared to the printing of graphics. This is achieved by tailoring the pigmented black ink to penetrate the print medium (paper) substantially evenly along the paper fibers.

In contrast, the dye-based color inks are tailored for spreading on the paper surface, since edge acuity in graphics is not considered to be of major concern by users. However, moderate edge acuity can be achieved by driving off solvent using a heater to limit the spread of the dye-based inks.

An advantage of pigmented inks is the lightfastness of the pigment. To date, the magenta dyes commonly used in ink-jet printers are not as lightfast as the cyan and yellow dyes. Accordingly, it is likely that a pigmented magenta ink may be developed. Such a pigmented magenta ink, or other pigmented color ink, may also be employed in the practice of the present invention. Thus, one or two of the three color inks may be pigmented, while the remaining ink(s) are water-miscible dye-based. However, the use of one pigmented color ink in conjunction with two water-miscible color inks and a pigmented black ink is not as preferred, and the use of two pigmented color inks in conjunction with one water-miscible color ink and a pigmented black ink is least preferred.

Finally, color inks containing a mixture of both pigment (s) and dye(s) are contemplated for use in the practice of the present invention. Such a mixture would provide a base lightfastness (from the pigment) and less spitting by replacing some pigment with dye.

INDUSTRIAL APPLICABILITY

The use of pigmented black ink in combination with at least one color ink containing one or more water-miscible dyes is expected to find use in thermal ink-jet printers.

Thus, there has been disclosed a color ink-jet printer with pigment black and dye-based color inks. It will be readily apparent to those skilled in this art that various changes and modifications of an obvious nature may be made, and all such changes and modifications are considered to fall within the scope of the present invention, as defined by the appended claims.

What is claimed is:

1. A color ink-jet printer employing a selected combination of pigment-based and dye-based inks in an ink-jet ink set, said color ink-jet printer including one print cartridge for dispensing black ink onto a print medium and at least one print cartridge for dispensing color ink onto a print medium such that a printed image is formed on said print medium by said black ink and said color ink, said black ink and said color ink together representing a ink-jet ink set, said print cartridge for dispensing black ink containing a pigment-based ink, said pigment-based ink comprising a vehicle and at least one pigmented colorant dispersed therein, and said at least one print cartridge for dispensing color ink containing a water-miscible dye-based ink, said dye-based ink including a vehicle and at least one water-soluble dye-based colorant, said ink-jet ink set employed in said color ink-jet printer thereby simultaneously realizing (a) greater edge acuity in said printed image by employing a pigment-based black ink rather than a dye-based black ink, and (b) reduced need for servicing said color ink-jet printer by employing at least one dye-based color ink rather than employing only pigment-based color inks in said ink-jet ink set.

2. The color ink-jet printer of claim 1 including three print cartridges for dispensing color, with one print cartridge adapted to dispense cyan ink, a second print cartridge adapted to dispense yellow ink, and a third print cartridge adapted to dispense magenta ink.

3. The color ink-jet printer of claim 2 wherein all three color inks each contain at least one water-miscible dye.

4. The color ink-jet printer of claim 2 wherein two of said color inks each contain at least one water-miscible dye.

5. The color ink-jet printer of claim 2 wherein one of said color inks contains at least one water-miscible dye.

6. The color ink-jet printer of claim 1 wherein at least one of said print cartridges for dispensing color ink contains both at least one water-miscible dye-based ink and at least one pigment.

7. The color ink-jet printer of claim 1 wherein each print cartridge comprises a separate pen.

8. The color ink-jet printer of claim 1 wherein all print cartridges together comprise a pen, with separate cartridges containing each ink.

9. The color ink-jet printer of claim 1 wherein each of said print cartridges comprises a plurality of firing chambers, each chamber provided with a resistor element for heating a quantity of ink to expel an ink droplet toward said print medium.

10. The color ink-jet printer of claim 1 further including a platen which supports said print medium, a portion of said platen provided with means for heating said print medium to reduce drying time of said ink.

11. A color thermal ink-jet printer employing a selected combination of pigment-based and dye-based inks in an ink-jet ink set, said color thermal ink-jet printer including one pen for dispensing black ink onto a print medium and three pens for dispensing color ink onto a print medium such that a printed image is formed on said print medium by said black ink and said color ink, said black ink and said color ink together representing an ink-jet ink set, said pen for dispensing black ink containing a pigment-based ink and said pens for dispensing color ink each containing a water-miscible dye-based ink, with one pen adapted to dispense cyan ink, a second pen adapted to dispense yellow ink, and a third pen adapted to dispense magenta ink, said ink-jet ink set thereby simultaneously realizing (a) greater edge acuity in said printed image by employing a pigment-based black ink rather than a dye-based black ink, and (b) reduced need for servicing said color ink-jet printer by employing water-miscible dye based color inks rather than pigment-based color inks.

12. The color ink-jet printer of claim 11 wherein all three color inks each contain at least one water-miscible dye.

13. The color ink-jet printer of claim 11 further including a platen which supports said print medium, a portion of said platen provided with means for heating said print medium to reduce drying time of said ink.

14. A method of ink-jet printing onto a print medium using a color ink-jet printer employing a selected combination of pigment-based and dye-based inks in an ink-jet ink set, said method comprising the steps of:

(a) providing a print cartridge for dispensing black ink and three print cartridges for dispensing color ink onto a print medium, said print cartridge for dispensing black ink containing a pigment-based black ink and said three print cartridges for dispensing color ink each containing a water-miscible dye-based color ink, with a first cartridge adapted to dispense cyan ink, a second cartridge adapted to dispense yellow ink, and a third cartridge adapted to dispense magenta ink;

(b) installing said print cartridge for dispensing black ink and said three print cartridges for dispensing color ink in said color ink-jet printer; and (c) printing said selected combination of pigment-based and dye-based inks onto said print medium to produce a printed image thereupon, thereby simultaneously realizing (i) greater edge acuity in said printed image by employing a pigment-based black ink rather than a dye-based black ink, and (ii) reduced need for servicing said color ink-jet printer by employing dye-based color inks rather than employing solely pigment-based inks in said ink-jet ink set.

15. The method of claim 14 wherein said print medium is heated so as to aid in drying of said ink on said print medium.

* * * * *